US005363957A

United States Patent [19]

Reichner

[11] Patent Number: 5,363,957

[45] Date of Patent: Nov. 15, 1994

[54] TOOL HOLDER

[75] Inventor: Patrick E. Reichner, Gladstone, Oreg.

[73] Assignee: Adventures Northwest Ltd., Gladstone, Oreg.

[21] Appl. No.: 98,131

[22] Filed: Jul. 26, 1993

[51] Int. Cl.[5] ..... A45C 11/26

[52] U.S. Cl. ..... 206/349; 206/207; 15/220.4

[58] Field of Search ..... 206/207, 209, 349, 234, 206/306; 15/220.4, 224.1, 218.1; 29/80

[56] References Cited

U.S. PATENT DOCUMENTS

| | | | |
|---|---|---|---|
| 561,765 | 6/1896 | Cloud et al. | 15/218.1 |
| 619,378 | 2/1899 | Whittenham | 15/218.1 |
| 739,807 | 9/1903 | Appleton | 15/218.1 |
| 1,051,279 | 1/1913 | Seymour | 15/218.1 |
| 1,240,880 | 9/1917 | Rink . | |
| 1,349,596 | 8/1920 | Wosiewski | 206/349 |
| 1,493,314 | 5/1924 | Zdrodowski | 206/349 |
| 1,509,015 | 9/1924 | Zdrodowski | 206/349 |
| 1,622,137 | 3/1927 | Egbert . | |
| 1,682,571 | 8/1928 | Horan | 206/207 X |
| 1,888,289 | 11/1932 | Raffles . | |
| 1,951,079 | 3/1934 | Zihlman | 15/220.4 |
| 2,262,753 | 11/1941 | Brennan | 206/209 |
| 2,453,452 | 11/1948 | Nielsen | 15/220.4 |
| 2,469,763 | 5/1949 | Conwell | 132/12 |
| 2,524,110 | 10/1950 | Kuemmerling | 206/349 X |
| 2,654,109 | 10/1953 | Barnes | 15/220.4 X |
| 3,205,525 | 9/1965 | Birtzer | 15/220.4 |
| 3,387,368 | 6/1968 | Scheck | 30/348 |
| 3,642,998 | 2/1972 | Jennings | 21/2.5 |
| 4,190,150 | 2/1980 | Bressell . | |
| 4,245,367 | 1/1981 | Stoute | 15/218.1 X |
| 4,257,464 | 3/1981 | Binney . | |
| 4,380,841 | 4/1983 | Thomas | 15/220.4 |
| 4,475,675 | 10/1984 | Miles | 224/191 |
| 4,714,159 | 12/1987 | Linden | 206/349 |
| 4,872,551 | 10/1989 | Theros | 206/349 |

FOREIGN PATENT DOCUMENTS

| | | | |
|---|---|---|---|
| 1083351 | 1/1955 | France | 206/306 |
| 2243762 | 11/1991 | United Kingdom | 15/220.4 |

*Primary Examiner*—Paul T. Sewell
*Assistant Examiner*—Ted Kavanaugh
*Attorney, Agent, or Firm*—Stephen S. Ford

[57] ABSTRACT

A tool holder slides over a tool protecting it from water and other rust inducing conditions. The tool holder comprises a cover having an internal cavity that holds two retainer sections of polyethylene. The retainer sections are sized to conform with the exterior profile of the tool and press firmly against opposite exterior surfaces of the tool as it is being inserted inside the tool holder. The retainer sections hold the tool snugly inside the cover cavity providing a highly effective insulation barrier. A lubricant is insertable inside the cover cavity and absorbed by the retainer sections and is automatically applied to the exterior surface of the tool as it is being inserted into the tool holder. The inside face of each retainer section have an abrasive surface that automatically scrubs the exterior surface of the tool while it is being inserted and removed from the holder.

20 Claims, 2 Drawing Sheets

TOOL HOLDER

BACKGROUND OF THE INVENTION

This invention relates generally to tool holders and more particularly to a device that prevents rust from accumulating on the exterior surface of various metal objects.

When inundated with rust, many tools become completely or partially inoperable. For example, rusted pliers often cannot open and shut properly, if at all. There are many metal objects, such as knives, that are no longer used when any rust appears on the surface.

To prevent rust, many tools are made from rust resistent materials, such as stainless steel. However, these materials are more expensive and often do not perform as well as the equivalent tool made from, for example, iron. For example, an iron file is cheaper and more effective in sharpening knives, saw blades, etc., than an equivalent file made from steel. In addition, stainless steel tools, or tools with a stainless steel plating can still become rusty if not cared for properly.

To prevent rust, many tools are meticulously cleaned and lubricated after every use. However, cleaning and drying tools after each use, is time consuming and in many cases is still not effective in preventing rust. To properly clean tools, they must first be wiped clean with a dry cloth then lubricated. If rust already exists on the exterior surface of the tool, it must be removed with a brush or other abrasive surface to prevent further surface deterioration. However, it is often difficult to remove water and other contaminants from the entire tool surface. For example, files have hundreds of fine grooves that cannot be easily accessed with a cloth rag. In addition, it is inconvenient to carry all the equipment needed to properly clean tools after each use. For example, it is often not possible to carry a dry cloth, oil, and a brush when traveling to a remote location, for example, when hiking or fishing.

Tools are often placed in general storage containers, such as a tool box or tackle box, to protect them from potentially destructive environmental conditions. For example, files used for sharpening fish hooks are typically placed in a tackle box when not in use. The file when placed in the tackle box is protected from external environmental conditions that can cause rust (i.e., rain). However, the file is still exposed to moisture and additional contaminates (i.e., fish guts) that will cause it to rust. This occurs when other fishing tackle is placed into the tackle box. For example, recently used fish hooks, lures, and bobbers, if wet, can disburse rust inducing moisture onto the file. Therefore, general purpose containers used for storing a wide variety of equipment are not effective in preventing rust.

Various apparatus have been devised to specially protect the outer surface of a single tool. U.S. Pat. No. 1,888,289 to Raffles, describes a saw holder that also oils or greases the saw when not being used. The interior of the holder is filled with grease or the like so that when the saw blade is inserted into the holder, grease is spread onto the saw's external surface. The end of the cover has a pair of felt pads press against opposite sides of the saw blade. The soft felt pads, however, are not effective in removing rust and other contaminants stuck firmly on the outside surface of the saw. In addition, the saw cover does not attach securely to the outside surface of the saw. Therefore, lubricant is not necessarily spread evenly over the saw surface.

U.S. Pat. No. 1,240,880 to Rink describes a combined scale sheath and cleaner. The sheath has felt pads similar to that previously shown in Raffles that are soaked with oil and are then pressed together on opposite sides to remove contaminants on the outside of the scale. The felt pads, as in Raffles, are too soft to effectively remove contaminants stuck firmly on the sides of the scale. In addition, the felt pads must be pressed together against the outside surfaces of the scale with one hand as the scale is being inserted vertically down into the sheath with a second hand. This is time consuming since only a small portion of the scale (i.e., the area pressed against the two small felt pads) is cleaned at any one time.

Accordingly, a need remains for a low cost, easy to carry tool holder that can insulate a tool from rust inducing environmental conditions and, at the same time, clean and lubricate the tool's outside surface.

SUMMARY OF THE INVENTION

It is, therefore, an object of the invention to prevent rust from accumulating on the exterior surface of a tool.

Another object of the invention is to insulate a tool from rust inducing environmental conditions and at the same time remove existing rust inducing contaminates from the exterior tool surface.

A further object of the invention is to increase the ease and convenience of cleaning and lubricating tools and other metal objects.

The invention relates to a tool holder arranged to protect the tool from rust inducing environmental conditions and at the same time clean and lubricate the tool's exterior surface. The tool holder is sized to conform with the exterior profile of the tool and is not much larger than the tool held therein. Thus, the tool holder is easy to carry, for example, on a belt, or in a tool or tackle box.

The tool holder includes a cover defining an internal cavity with an opening at a first end. Two rigid retainer sections are made of polyethylene and are held firmly against each other within the cavity. A tool is then inserted between the two retainer sections inside the tool holder. Opposite interior surfaces of the retainer sections conform to and press against the surface of the tool, holding the tool snugly inside the cavity.

The interior surface of each retainer section is abrasive and automatically scrubs the tool surface while the tool is being inserted and removed from the tool holder. The retainer sections press firmly enough against the tool to remove contaminants such as rust. Thus, the tool holder automatically cleans the tool as it is being inserted into and removed from the tool holder.

A lubricant may be injected into the tool holder and absorbed by the retainer sections. Because some of the lubricant resides on the inside surface of each retainer section, a thin film of lubricant is applied to the surface of the tool during insertion and extraction. Thus, the tool holder both cleans and lubricates the tool while also providing an insulation barrier around the tool that protects against the environment.

The tool holder is inexpensive to manufacture and assemble. For example, the cover comprises a low cost water resistent polyvinyl compound that insulates the interior cavity from outside moisture. The retainer sections are also easily fabricated by simply cutting the internal cells of a polyethylene material into two open cell surfaces. The open cells of the polyethylene provide the abrasive surface that both cleans and lubricates the outside surface of the tool. The polyvinyl cover along with the polyethylene retainer sections have the added advantage of allowing the inserted tool to float in water. Thus, the tool holder prevents a tool from being lost when inadvertently dropped in water.

The tool holder is assembled by simply sliding the retainer sections through the cover opening into the cover cavity. A cap having a slot is then attached over the cover opening and the end of the retainer sections. Because the retainer sections press firmly against opposite sides of the tool, no special snaps, zippers, or other attachments are needed to hold the tool inside the tool holder. Thus, the tool holder is easy to assemble and is made out of a minimal number of materials providing a low cost system for protecting tools from rust.

In one embodiment, the tool holder is elongate with a generally rectangular cross-sectional shape for holding a file. As the file is inserted into the tool holder, the retainer sections scrub the fine grooves in the outside surface of the file removing rust and other contaminants. At the same time, lubricant from the retainer sections is applied to opposite sides of the file, further preventing rust and curing the file for its next use. The tool holder, therefore, effectively cleans and lubricates the tool with a minimal amount of time and effort. Since, the tool holder both cleans and lubricates the file, no additional cleaning equipment has to be used are carried along with the tool holder, further reducing the cost and effort of maintaining a rust free tool.

The foregoing and other objects, features and advantages of the invention will become more readily apparent from the following detailed description of a preferred embodiment which proceeds with reference to the drawings.

DETAILED DESCRIPTION OF THE PREFERRED EMBODIMENT

Figure 1:
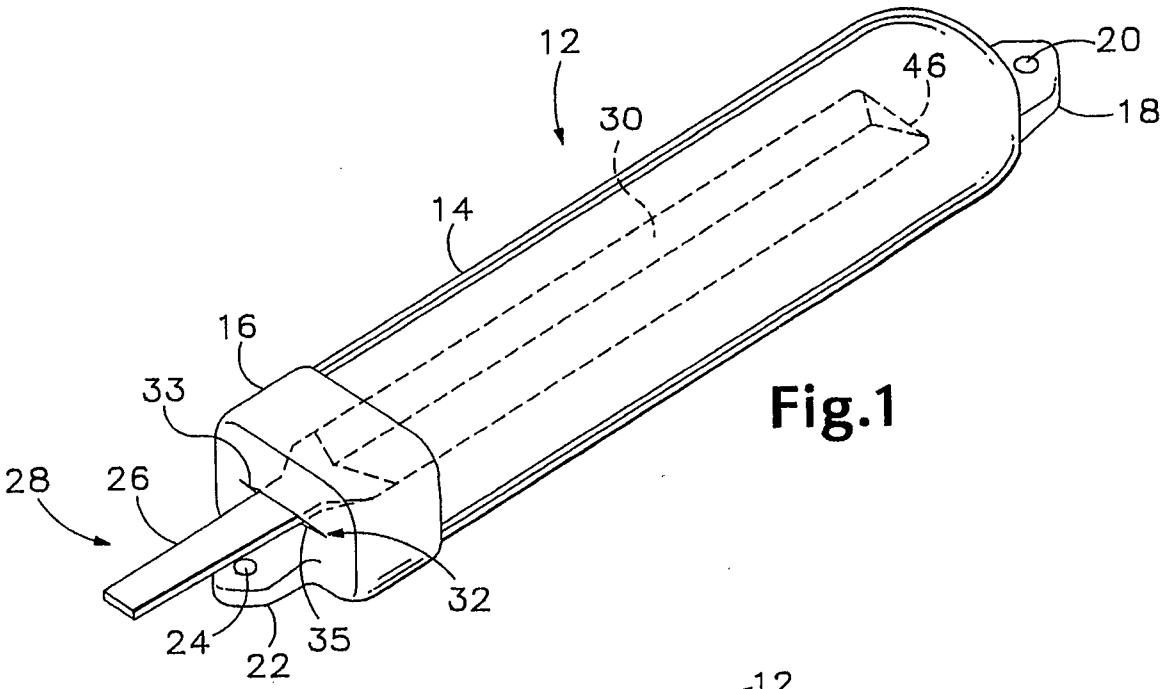
FIG. 1 is a perspective view of a tool holder according to the invention.

FIG. 1 is a perspective view of a tool holder 12 according to the invention. The tool holder 12 comprises an exterior polyvinyl cover 14 that inserts at a front end into a cap 16. The front of cap 16 has a slot 32 with a top lip 33 and a bottom lip 35 for receiving tools such as a file 28. A tab 18 having a hole 20 is molded into a bottom end of cover 14 and a tab 22 having a hole 24 is molded into the top of cap 16. The file 28 includes a top working surface 30 coupled at a top end to a handle 26. Working surface 30 contains an array of fine cross-hatched grooves for sharpening various metal objects, such as knives and fish hooks.

Figure 2:
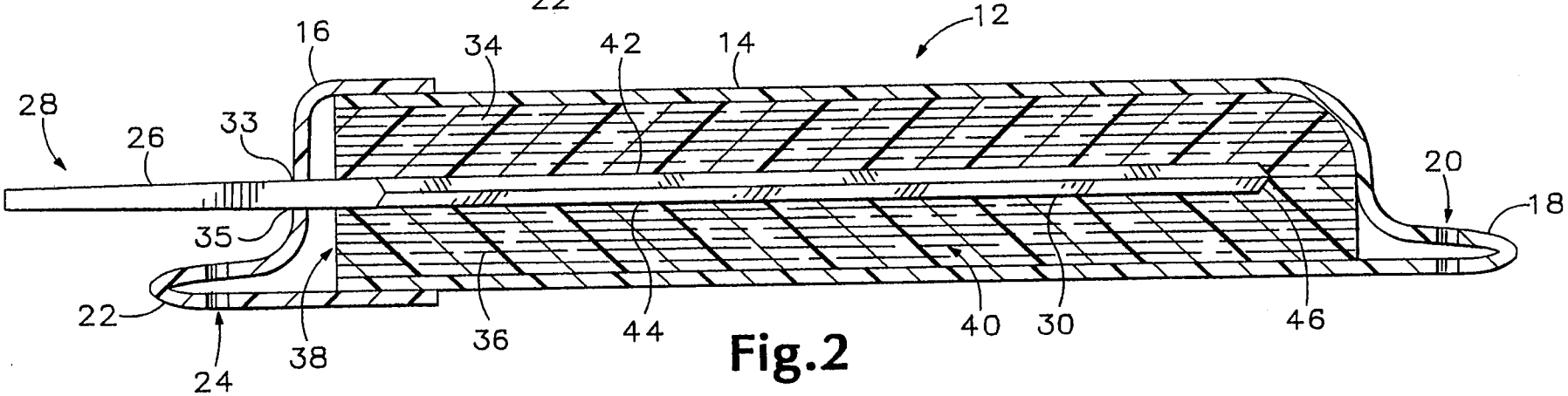
FIG. 2 is a side sectional view of the tool holder shown in FIG. 1.

FIG. 2 is a side sectional view of the file holder 12 shown in FIG. 1. Cover 14 defines a cavity 40 having an opening 38 at a top end. Two compressible polyethylene retainer sections 34 and 36 are held together along inside faces 42 and 44, respectively, inside cavity 40. The cavity 40 has a cross-sectional shape substantially equal to or slightly less than the cross-sectional profile of the two retainer sections 34 and 36 when pressed together. Thus, covers 14 are held securely inside cavity 140.

For illustrative purposes, the tool holder, as shown in FIGS. 1 and 2, will be described for use with a file. However, alternative configurations of the file holder 12 can be fabricated to accept a wide variety of other tools such as chisels, pliers, knives, scissors, wrenches, etc., as will be described further below.

Referring both to FIGS. 1 and 2, the internal retainer sections 34 and 36 are sized generally to follow the external profile of file 28. For example, retaining sections 34 and 36 are elongate having front and back lateral ends. Cover 14 holds the retainer sections 34 and 36 snugly together inside cavity 40. Therefore, when file 28 is inserted into file holder 12, the polyethylene retaining sections 34 and 36 compress slightly allowing file 28 to slide snugly between the inside faces 42 and 44. In the preferred embodiment, the polyvinyl cover 14 also provides a slight amount of elasticity further allowing separation between retainer sections 34 and 36.

File 28 is inserted longitudinally between retainer sections 34 and 36 until it resides in the fully inserted position shown in FIGS. 1 and 2. In the compressed state, retainer sections 34 and 36 seal against opposite exterior sides of file 28. This cohesive seal prevents air, water, and other rust inducing contaminates from accessing file working surface 30.

It is important to note that both retainer sections 34 and 36 extend longitudinally along the entire working surface 30 of file 28. Thus, the entire outside working surface 30 of file 28 is securely insulated from the environment. In addition, by sizing the retaining sections 34 and 36 to the same length as file 28, the file is held more securely inside cover 14 and provides a more effective means for cleaning file 28 with the least amount of effort.

For example, as previously shown in Raffles and Rink, prior tool holders only use a small strip of felt to clean the surface on the inserted tool. However, the entire internal lining of tool holder 12 (i.e., retainer sections 34 and 36) is used to scrub the outside surface of file 28. Thus, the front end 46 of file 28 is scrubbed continuously as it is inserted into tool holder 12. In addition, since retaining sections 34 and 36 are compressible, they conform around the outside surface of file 28. Therefore, the retainer sections naturally press against the tool as it is inserted into the tool holder. This obviates manually pressing together the retainer sections in order to clean the outside surface of file 28.

Figure 3:
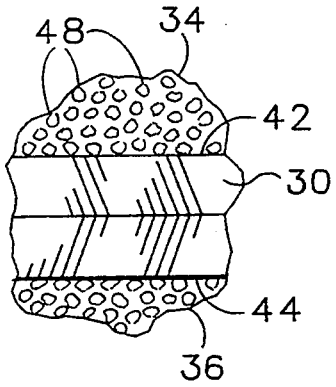
FIG. 3 is an enlarged view showing the internal cells of the retainer sections used in the tool holder shown in FIG. 1.

FIG. 3 is an enlarged view of file 28 inserted between retainer sections 34 and 36. Retainer sections 34 and 36, in a preferred embodiment, are made out of a polyethylene having internal cells 48. The polyethylene is cut so that the internal cells 48 are partially open at the inside faces 42 and 44. The open cells provide an abrasive surface that scrubs the exterior surface of file 28 when inserted between retainer sections 34 and 36.

The polyethylene also retains oil used for lubricating the file as it is being inserted and extracted from file holder 12. The retainer sections act as a sponge first absorbing lubricant poured in through slot 32 (FIG. 1). As file 28 is inserted into the file holder, the retainer sections disperse the previously absorbed lubricant onto the exterior surface of file 28. Because the retainer sections 34 and 36 conform around the external surface of file 28 during insertion, a consistent coating of lubricant is applied over the entire exterior surface of file 28. Other tool holders do not positively press against the exterior surface of the tool during insertion, therefore, lubricant may not be applied to all portions of the tool surface.

Referring back to FIG. 2, lubricant is inserted into cavity 36 by pressing at opposite sides of cap 16 forcing lips 33 and 35 to separate forming a gap. Any oil recommended by the tool manufacturer is then simply poured from a container through the gap in slot 32 into cavity 40. The oil then seeps throughout retaining sections 34 and 36, naturally progressing down by gravity through the cavity. The dispersion rate of oil between the retaining sections can be increased by simply moving file 28 several times in and out of the tool holder 12. Because the retainer sections are absorbent, a large reservoir of lubricant can be stored in file holder 12. Therefore, tool holder 12 does not have to be refilled with lubricant as often as tool holders using felt pads.

Cap 16 provides a second protective barrier between file 28 and the environment. For example, as file 28 is inserted into slot 32 of cap 16, lips 33 and 35 press against the top and bottom sides of file 28, respectively, scraping loose particulate matter from the outside surface. As file 28 is inserted further between retainer sections 34 and 36, the inside retainer faces 42 and 44 scrub additional particulate matter from the file's external surface. In the fully inserted position shown in FIG. 2, lips 33 and 35 press against opposite sides of file 28, preventing moisture and contaminants from accessing cavity 40.

To assemble tool holder 12, retaining sections 34 and 36 are slidingly inserted in a longitudinal direction inside cavity 40 through opening 38. After retainer sections 34 and 36 have been inserted, cap 16 is seated over opening 38 and glued to the outside of cover 14. The glue provides a water resistant seal between cap 16 and cover 14. Lubricant is then inserted into cavity 40 through slot 32. Thus, tool holder 12 is assembled in a minimal amount of time reducing manufacturing costs.

In a preferred embodiment, cover 14 and cap 16 are made of a polyvinyl coating, however, they may also be made out of a variety of materials including leather, hard plastic, aluminum, neoprene, rubber, fiberglass, or nylon. The polyethylene retainer sections 34 and 36 can also be made out of any variety of different compressible materials that provide an abrasive inside surface and that do not break down under the various lubricants and oils inserted inside the tool holder cavity 40. The materials used for retainer sections 34 and 36, cover 14, and for cap 16 also allow the tool inserted into tool holder 12 to float in water. For example, while inserted into file holder 12, file 28 would float if accidentally dropped into a lake or river.

Tool holder 12 operates in the following manner. File 28, after being used, is stored in tool holder 12 by inserting a front lateral end 46 through slot 32. Loose contaminates and water are removed from the external surface of file 28 by the two lips 33 and 35 of slot 32. As the front lateral end 46 of file 28 is inserted further between retaining sections 34 and 36, the retainer inside surfaces 42 and 44 further scrub the exterior surface of file 28 removing additional contaminates such as rust and water. At the same time that the exterior surface of file 28 is being cleaned by retainer sections 34 and 36, a fine layer of lubricant is also applied to the exterior file surface. Thus, retainer sections 34 and 36 both clean and lubricate the external surface of file 28 at the same time, reducing the amount of time required to clean file 28. In the fully inserted position, file 28 is held firmly inside cavity 40, by retainer sections 34 and 36. For example, the slightly compressed retainer sections press firmly against the top and bottom faces of file 28, holding file 28 securely in the file holder.

The file is easily removed from file holder 12 by pulling handle 26 laterally out from slot 32. As file 28 is being removed, retainer faces 42 and 44 further clean and lubricate the exterior file surface. When file 28 is completely removed, lips 33 and 35 come together, sealing the cavity 40 from the environment.

As mentioned above, the tool holder can be manufactured in a variety of different shapes and sizes dependent upon the type of tool. For example, a tool holder can be designed to hold router bits, drill bits, knives, pliers, screw drivers, saws, guns, or any other tool susceptible to rust. In addition, due to the relatively small size, file holder 12 can be easily carried in a tool or tackle box or can be carried on a belt.

Figure 4:
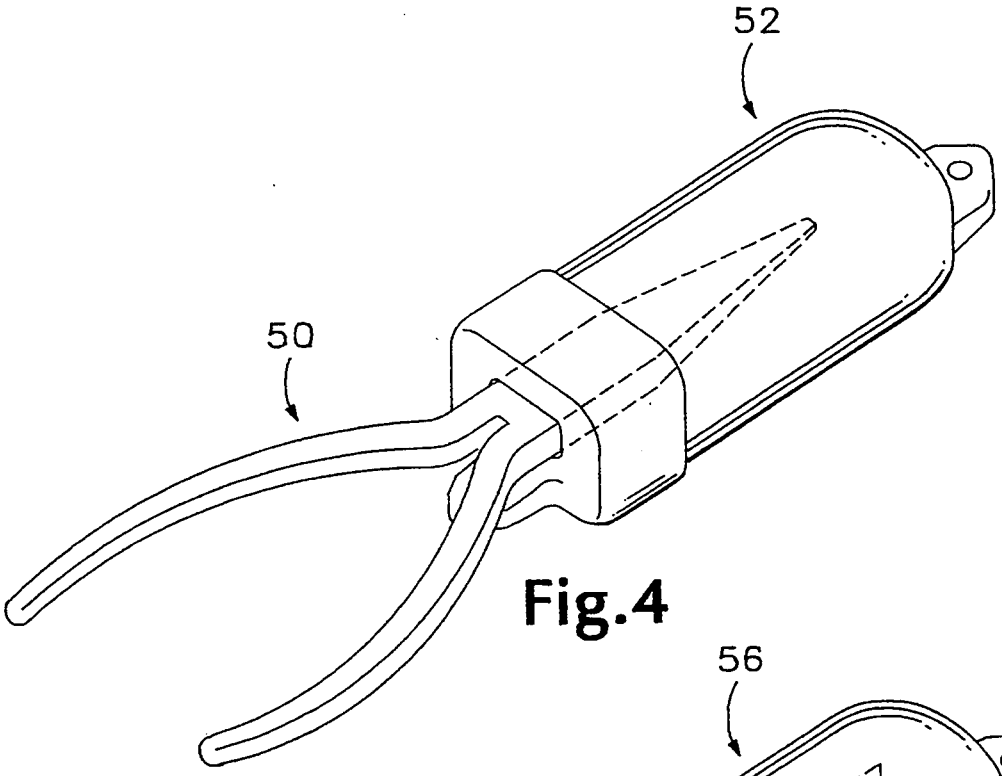
FIG. 4 is an alternative embodiment of the invention used to hold a pair of needle-nose pliers.
Figure 5:
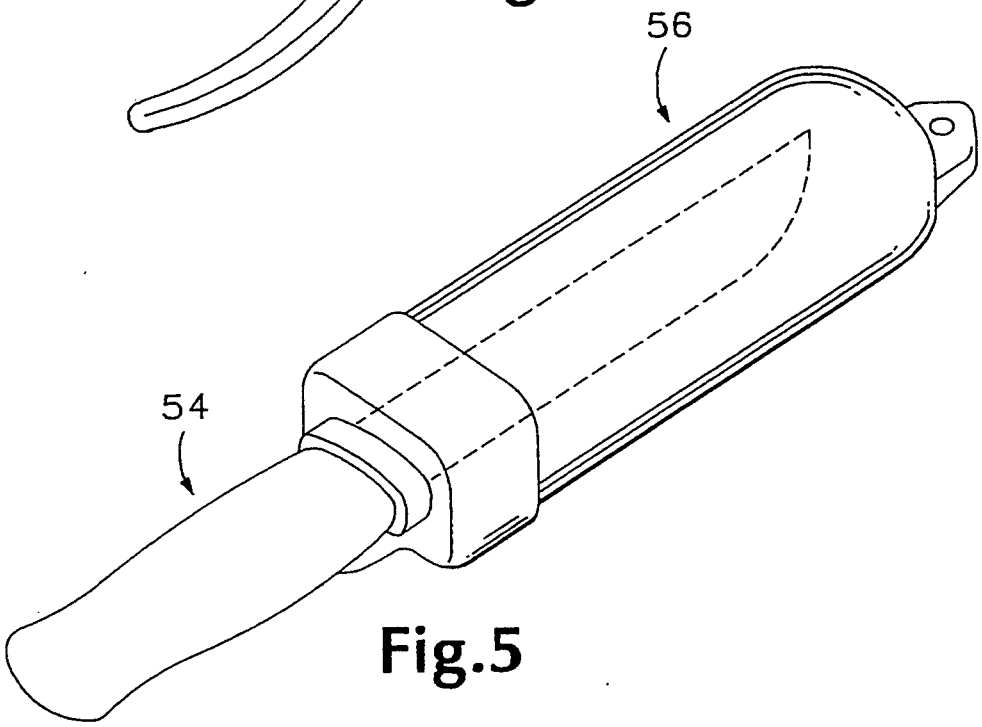
FIG. 5 is an alternative embodiment of the invention used to hold a knife.

FIG. 4 shows a tool holder 52 according to the invention used for holding a pair of needle-nose pliers 50 and FIG. 5 shows a tool holder 56 according to the invention used for holding a knife 54. The cool holders 52 and 56 can also be strapped to a belt and used as a carrying case for pliers 50 and knife 54, respectively. Both the thickness and length of the retaining sections are altered according to the length and cross-sectional size of the tool. For example, the retainer sections in tool holder 56 (FIG. 5) may be thicker to press more firmly against the narrow blade of knife 54.

Thus, the tool holder according to the invention is effective in protecting various tools and metal apparatus from rust and corrosion due to moisture and other external environmental conditions. The tool holder removes various contaminates from the outside surface of the tool quicker and more effectively than prior tool holders while at the same time spreading a more consistent layer of lubricant on the exterior tool surface. In addition, the tool holder 12 is easily assembled and can be manufactured at low cost and with a minimal number of parts. Since the tool holder has substantially the same profile as the inserted tool, it uses minimal space and can, therefore, be easily stored in container typically used to carry the tool.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A tool holder, comprising:

a unitary piece of flexible molded material formed into a cover having front and back walls joined together by side walls; the front, back and side walls each having a bottom end joined together by an end section thereby defining an elongated water impervious cavity open at a top end; and two compressible retainer sections extending substantially the entire length of the cavity and sized larger than the cavity so that said retainer sections when inserted inside the cover cavity are held together in constant compression solely by force of the front and back walls of the cover independent of external forces, the retainer sections having opposed inside faces for holding a tool inserted therebetween.

2. A tool holder according to claim 1 including a tool having a working surface with front and back sides wherein the retainer sections are sized to conform with the front and back sides, so that the inside face of each retainer section presses against substantially the entire front and back side of the inserted tool, respectively at the same time.

3. A tool holder according to claim 2 wherein the inside face of each retainer section is abrasive so that said inside faces scrub the entire front and back sides of the tool at the same time as said tool is being inserted and removed from the retaining sections.

4. A tool holder according to claim 3 wherein the retainer sections comprise a cellular material cut into an open cell configuration at the inside faces.

5. A tool holder according to claim 4 wherein the retaining sections are made from polyethylene.

6. A tool holder according to claim 2 wherein the retainer sections comprise semi-rigid pieces of polyethylene each having a rectangular profile with flat front and back sides, the polyethylene placed in further compression when the tool is inserted in the tool holder thereby conforming snugly about substantially the entire front and back sides of the tool.

7. A tool holder according to claim 1 including a cap having a slot aligned over the opposed inside faces of the retainer sections and removably attached over the cover, the cap being formed of elastically compressible material so that pressure exerted against opposite ends of the cap along the slot to open allowing the tool to be slidingly inserted through the cap slot into the cover cavity.

8. A tool holder according to claim 1 wherein the retainer sections comprise means for retaining and dispersing a lubricant so that as said tool is inserted therebetween the retaining sections disperse said lubricant onto substantially the entire working surface of the tool at the same time.

9. A tool holder according to claim 1 wherein the cover cavity has a uniform cross-sectional shade that remains substantially constant from the bottom end to the top opening and the two retainer sections have a combined cross-sectional shape substantially equal to the cross-sectional shape of the cover cavity when compressed, the retainer sections thereby slidingly insertable through the top end into the cover cavity.

10. A tool holder according to claim 1 wherein the cover comprises a water resistent polyvinyl compound that insulates the interior cavity of the cover from moisture.

11. A tool holder according to claim 1 wherein the cover and retainer sections provide sufficient buoyancy to allow the combined tool holder and tool to float on water.

12. A toolholder, comprising:

a tool having a working surface including a front and back side defining an exterior tool profile;

two semi-rigid retainer sections applying a constant force against substantially the entire front and back side of the tool each retainer section having a front side, a back side and a bottom side the front side of each retainer section sized to conform generally with the exterior profile of the tool and abutted together to form a retaining slot that slidingly receives and holds the working surface of the tool; and a sheath for holding the retainer sections in constant compression while at the same time water impervious seal around the entire front bottom sides of the retainer sections, the sheath having elastically pliable front and back portions together by elastically pliable side portions molded internal cavity for holding the two retainer sections and having an opening at a first end for receiving the tool;

the front and back portions exerting pressure against the retainer sections causing the front sides of each retainer section to press snugly against the front and back side of the tool as said tool is slidingly inserted through the sheath opening into the retaining slot.

13. A tool holder according to claim 12 wherein each retainer section is elongate and rectangularly shaded having flat front and back sides extending from a top end to the bottom end, the tool insertable between and along a lengthwise direction of the retainer sections through the top end.

14. A tool holder according to claim 12 wherein the tool comprises an elongate file having first and second lateral ends and a front and back face, the retaining sections sized to press against substantially the entire front and back file faces at the same time.

15. A tool holder according to claim 14 wherein the sheath's internal cavity has substantially the same dimensions as an exterior surface of the retainer sections thereby having a cross-sectional shape substantially equal to a cross-sectional shape of the retainer sections.

16. A method for preventing corrosion on an exterior surface of a tool, comprising:

providing a sheath having an internal cavity with a top opening and a given width:

providing two elongated retainer sections each having an inside face;

signing the retainer sections to extend substantially the entire length of the sheath cavity and to have a greater width than the given width of the internal cavity;

abutting together the entire inside face of each retainer section;

forcibly sliding the retainer sections into the cavity through the top opening, the sheath thereby compressing the two retainer sections together without an externally applied force;

fastening the tool inside the sheath cavity by forcibly sliding the tool between the two retainer sections, the tool thereby further compressing the retainer sections so that the tool is held firmly therebetween.

17. A method according to claim 16 wherein each retainer section includes an outside face joined to the face by opposite lateral sides and the sheath side walls that extend completely around the later sides of said retainer section and sized to less than the width of the combined width of the retainer sections thereby holding the sheath includes compressional force against the outside retainer sections independently of any outside force, respectively, causing the inside faces of the retainer sections to press against the tool with sufficient force to remove contaminants such as rust while at the same time leaving a thin film of lubricant.

18. A method according to claim 17 including automatically cleaning the external tool surface by sliding the tool in and out from between the two retainer sections.

19. A method according to claim 17 including storing a lubricant inside and throughout the entire internal cavity of the sheath and automatically dispensing the lubricant concurrently onto the entire tool surface as said tool is inserted between the retainer sections.

20. A method according to claim 19 wherein the lubricant is absorbed by the retainer sections and automatically discharged from the retainer sections when the tool is inserted therebetween.

* * * * *